US009408432B2

(12) United States Patent
Bruce et al.

(10) Patent No.: US 9,408,432 B2
(45) **Date of Patent: *Aug. 9, 2016**

(54) ARTICLE OF FOOTWEAR WITH A MARKING SYSTEM

(75) Inventors: Robert M. Bruce, Portland, OR (US); Aaron A. C. Cooper, Portland, OR (US); Bo Lupo, Portland, OR (US); Kurt Stockbridge, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 662 days.

This patent is subject to a terminal disclaimer.

(21) Appl. No.: 12/211,402

(22) Filed: Sep. 16, 2008

(65) Prior Publication Data

US 2009/0293316 A1 Dec. 3, 2009

Related U.S. Application Data

(63) Continuation-in-part of application No. 12/129,216, filed on May 29, 2008.

(51) Int. Cl.

| | |
|---|---|
| ***A43B 5/00*** | (2006.01) |
| ***A43B 3/00*** | (2006.01) |
| ***A43B 23/02*** | (2006.01) |
| ***A63B 71/06*** | (2006.01) |
| ***A63B 24/00*** | (2006.01) |
| *A43B 1/00* | (2006.01) |

(52) U.S. Cl.

CPC ... *A43B 5/00* (2013.01); *A43B 3/00* (2013.01); *A43B 3/0052* (2013.01); *A43B 3/0078* (2013.01); *A43B 23/02* (2013.01); *A63B 71/0605* (2013.01); *A43B 1/0027* (2013.01); *A63B 2024/0025* (2013.01); *A63B 2220/803* (2013.01)

(58) Field of Classification Search

CPC .. A43B 3/0036; A43B 3/0052; A43B 3/0078; A43B 5/00; A43B 23/02; A63B 24/0003; A63B 2024/0025

USPC ..... 36/97, 112, 113, 132, 136

See application file for complete search history.

(56) References Cited

U.S. PATENT DOCUMENTS

| | | | | |
|---|---|---|---|---|
| 801,899 | A * | 10/1905 | McQuiston | 36/1 |
| 2,473,877 | A | 6/1949 | Goldstein | |
| 2,503,586 | A | 4/1950 | Miller | |

(Continued)

FOREIGN PATENT DOCUMENTS

| | | |
|---|---|---|
| CN | 1166774 | 12/1997 |
| FR | 2733880 | 11/1996 |

(Continued)

OTHER PUBLICATIONS

International Search Report and Written Opinion, mailed Aug. 3, 2009, from PCT Application No. PCT/US2009/045439.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear with a marking system is disclosed. The marking system is configured to help locate one or more portions of a foot during training of an athlete. The marking system includes markings disposed on an upper of an article of footwear.

17 Claims, 7 Drawing Sheets

(56) References Cited

U.S. PATENT DOCUMENTS

| | | | | | |
|---|---|---|---|---|---|
| 3,641,687 | A | | 2/1972 | Hibbard et al. | |
| 4,199,881 | A | | 4/1980 | Francis | |
| 4,550,510 | A | * | 11/1985 | Stubblefield | 36/32 R |
| 4,631,676 | A | * | 12/1986 | Pugh | 600/595 |
| 5,203,097 | A | * | 4/1993 | Blair | 36/59 C |
| 5,240,418 | A | * | 8/1993 | Silverman et al. | 434/260 |
| 5,381,614 | A | | 1/1995 | Goldstein | |
| 5,800,364 | A | * | 9/1998 | Glennie et al. | 600/592 |
| 6,912,802 | B2 | | 7/2005 | Cooper | |
| D529,691 | S | | 10/2006 | Earle | |
| 7,228,649 | B2 | | 6/2007 | Elliott | |
| 7,287,342 | B2 | * | 10/2007 | Keen | 36/50.1 |
| D559,511 | S | | 1/2008 | Wu | |
| 7,325,337 | B2 | | 2/2008 | Cox et al. | |
| 7,748,145 | B2 | | 7/2010 | Jones et al. | |
| 7,881,768 | B2 | * | 2/2011 | Lang et al. | 600/407 |
| D659,363 | S | | 5/2012 | Leary et al. | |
| 2004/0159019 | A1 | | 8/2004 | Cooper | |
| 2005/0016032 | A1 | * | 1/2005 | Cox et al. | 36/136 |
| 2005/0037844 | A1 | | 2/2005 | Shum et al. | |
| 2006/0048413 | A1 | * | 3/2006 | Sokolowski et al. | 36/45 |
| 2006/0225305 | A1 | | 10/2006 | Morgan et al. | |
| 2007/0011910 | A1 | | 1/2007 | Keen | |
| 2008/0015433 | A1 | | 1/2008 | Alexander et al. | |
| 2009/0293313 | A1 | | 12/2009 | Bruce et al. | |

FOREIGN PATENT DOCUMENTS

| | | |
|---|---|---|
| WO | 9715205 | 5/1997 |
| WO | 2007097048 | 8/2007 |

OTHER PUBLICATIONS

Notification Concerning Transmittal of International Preliminary Report on Patentability mailed Dec. 9, 2010 in International Application No. PCT/US2009/045439.
Utility U.S. Appl. No. 12/129,216, filed May 29, 2008.
Office Action mailed Oct. 7, 2011 in U.S. Appl. No. 12/129,216.
Chinese Office Action issued Sep. 30, 2011 in Chinese Application No. 200980129663.0.
The International Search Report and The Written Opinion of The International Searching Authority, or The Declaration mailed Mar. 19, 2012 in PCT Application No. PCT/US2009/045130.
Notification Concerning Transmittal of International Preliminary Report on Patentability, mailed Apr. 12, 2012 in PCT Application No. PCT/US2009/045130.
Chinese Office Action mailed Sep. 30, 2011 in Chinese Application No. 200980129663.0.
Office Action from U.S. Appl. No. 12/129,216, mailed Oct. 7, 2011.
Final Office Action from U.S. Appl. No. 12/129,216, mailed Mar. 28, 2012.
Chinese Office Action issued Jul. 25, 2013 in Chinese Application No. 200980127988.5, and English translation thereof.
Amendment filed Jan. 9, 2012 in U.S. Appl. No. 12/129,216.
Amendment filed May 29, 2012 in U.S. Appl. No. 12/129,216.
Notification of Divisional Application issued Mar. 18, 2013 in Chinese Patent Application No. 200980127988.5, and English translation thereof.
Notification of the Decision to Grant issued Jun. 28, 2012 in Chinese Patent Application No. 200980129663.0, and English translation thereof.
English language translation of Response to Office Action in Chinese Patent Application No. 200980127988.5.
Office Action dated Dec. 17, 2013 in U.S. Appl. No. 12/129,216.
Extended European Search Report dated Dec. 3, 2013 in EP Application No. 09759038.4.
European Search Report for EP Application No. 09755721.9 dated Dec. 3, 2013, 7pp.
Response to Office Action filed Mar. 18, 2014 in U.S. Appl. No. 12/129,216.
Supplemental Amendment filed Mar. 19, 2014 in U.S. Appl. No. 12/129,216.
Notification of the Decision to Grant a Patent Right for Patent for Invention dated Mar. 3, 2014 in Chinese Patent Application 200980127988.5.
Response to Written Opinion filed Feb. 5, 2014 in European Patent Application 09755721.9.
Response filed Jun. 20, 2014 in European Patent Application No. 09759038.4.
Final Office Action mailed Jul. 7, 2014 in U.S. Appl. No. 12/129,216.
Supplemental Final Office Action mailed Oct. 1, 2014 in U.S. Appl. No. 12/129,216.
Advisory Action mailed Dec. 31, 2014 in U.S. Appl. No. 12/129,216.
Office Action mailed Oct. 6, 2015 in U.S. Appl. No. 12/129,216.
Amendment filed Jan. 6, 2016 in U.S. Appl. No. 12/129,216.

* cited by examiner

ARTICLE OF FOOTWEAR WITH A MARKING SYSTEM

RELATED U.S. APPLICATION DATA

This application is a continuation in part of U.S. Patent Application Publ. No. 2009/0293313, published on Dec. 3, 2009, entitled "Article of Footwear With a Marking System" (referred to herein as "the Marking System Case"), the subject matter of which is incorporated herein in its entirety by reference.

BACKGROUND OF THE INVENTION

1. Field of the Invention

The present invention relates to an article of footwear, and in particular to an article of footwear with a marking system.

2. Description of Related Art

Articles of footwear with stripes or markings have been previously proposed. Cox (U.S. Pat. No. 7,325,337) teaches footwear with changeable stripes. Cox teaches a shoe that can have a stripe located within a recess upon the back counter or rear heel portion of the shoe, where the stripe may extend further thereunder, during application. Thus, the stripe may be located within the recess, or it may be removed, and reversed, and relocated therein. Such a stripe can be fabricated of a luminescent material, in order to furnish some glowing, during the evening or night, to furnish safety to the footwear when worn.

Cox fails to teach provisions for facilitating locating one or more portions of a foot for training purposes. Cox also fails to teach provisions for training an athlete using one or more markings. There is a need in the art for a design that overcomes these shortcomings.

SUMMARY OF THE INVENTION

The invention discloses an article of footwear with a marking system. In one aspect, the invention provides an article of footwear, comprising: an upper including a first portion and a second portion; the second portion being disposed between the first portion and a sole system of the article of footwear; a marking system associated with the upper, the marking system including a set of markings; each marking of the marking system extending through the first portion; and wherein the marking system is configured to facilitate locating a predetermined portion of a foot.

In another aspect, the marking system includes a first marking disposed in a toe portion of the upper.

In another aspect, the marking system includes a second marking disposed in a lateral portion of the upper.

In another aspect, the marking system includes a third marking disposed in a heel portion of the upper.

In another aspect, the marking system includes a fourth marking disposed in a medial portion of the upper.

In another aspect, at least one marking of the set of markings extends to an outsole of the sole system.

In another aspect, the invention provides an article of footwear, comprising: an upper; a marking system associated with the upper, the marking system including a set of markings; the marking system including a first marking and a third marking that define a longitudinal axis along a length of the sole system; the marking system including a second marking and a fourth marking that define a lateral axis along a width of the sole system; and where the intersection of the longitudinal axis and the lateral axis corresponds to a predetermined portion of a foot.

In another aspect, the upper includes a first portion and a second portion disposed between the first portion and a sole system and wherein the marking set is disposed in the first portion.

In another aspect, the marking set extends through the first portion and the second portion.

In another aspect, the longitudinal axis and the lateral axis intersect in a forefoot portion of the upper.

In another aspect, the longitudinal axis and the lateral axis intersect in a portion of the upper that corresponds to a ball of a foot.

In another aspect, the marking set has a cross-hair configuration.

In another aspect, a portion of the marking system is visible when the article of footwear is planted on the ground.

In another aspect, the invention provides a method of using an article of footwear, comprising the steps of: observing the location of a plurality of markings associated with a marking system on an upper of the article of footwear when a lower surface of a sole system is in contact with a ground surface; and determining the relative location of a predetermined portion of a foot disposed in the upper according to the location of the plurality of markings, wherein the predetermined portion is disposed on the upper.

In another aspect, the predetermined portion is a portion of the upper corresponding to a ball of a foot.

In another aspect, the plurality of markings are visible on a side peripheral portion of the upper.

In another aspect, the step of determining the relative location of the predetermined portion includes a step of associating a longitudinal axis and a lateral axis with the plurality of markings.

In another aspect, the step of associating the longitudinal axis and the lateral axis with the plurality of markings is followed by a step of determining the intersection of the longitudinal axis and the lateral axis.

In another aspect, the article of footwear can be used to train an athlete.

In another aspect, the motion of the article of footwear as a wearer moves can be recorded with a monitoring device and analyzed on a video display system.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF ONE EMBODIMENTS

Figure 1:
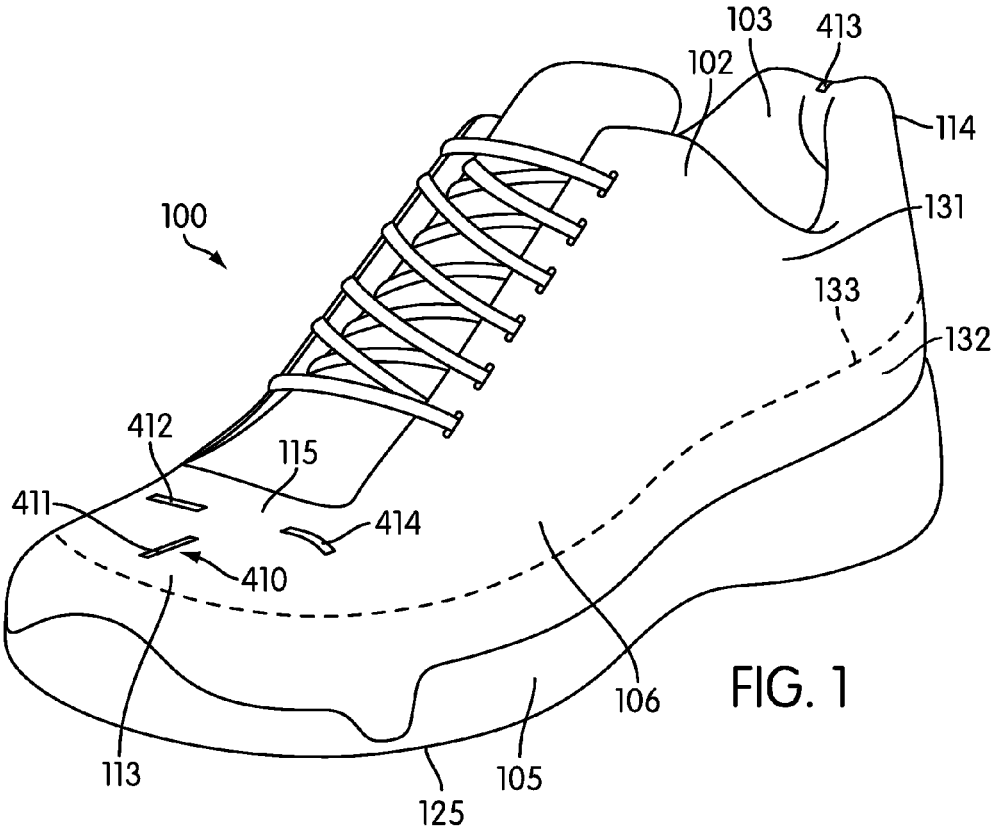
FIG. 1 is an isometric view of an embodiment of a medial portion of an article of footwear.
Figure 2:
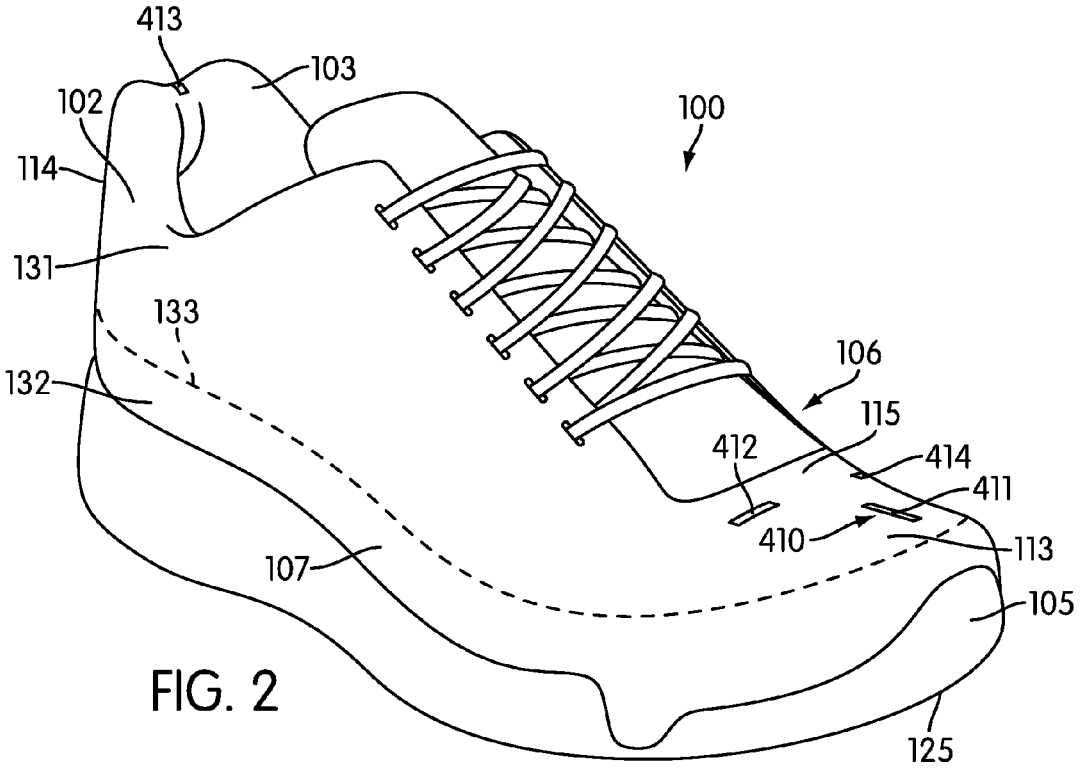
FIG. 2 is an isometric view of an embodiment of a lateral portion of an article of footwear.
Figure 3:
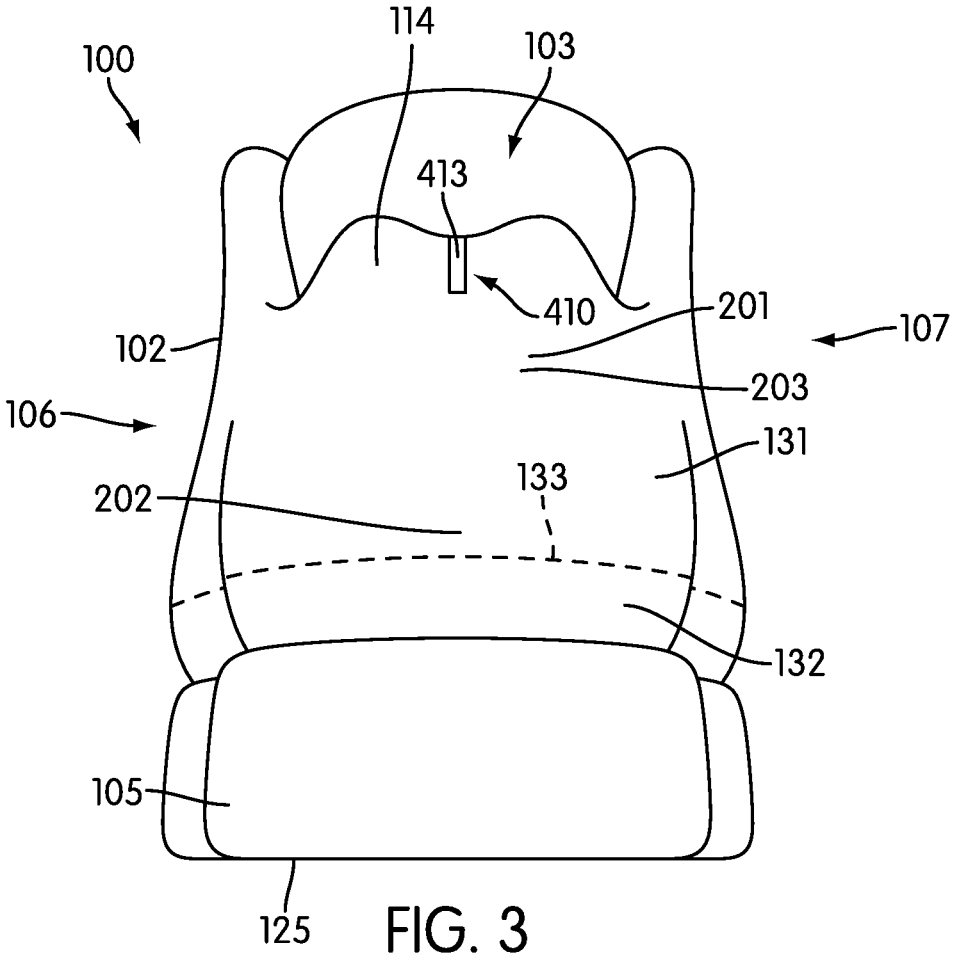
FIG. 3 is an isometric view of an embodiment of a heel portion of an article of footwear.

FIGS. 1-3 illustrate an embodiment of article of footwear 100. In particular, FIG. 1 is an isometric view of an embodiment of a medial portion of article of footwear 100 and FIG. 2 is an isometric view of an embodiment of a lateral portion of article of footwear 100. FIG. 3 is an isometric view of an embodiment of a heel portion of article of footwear 100. For clarity, the following detailed description discusses an embodiment, in the form of a sneaker, but it should be noted that the present invention could take the form of any article of footwear including, but not limited to soccer shoes, football shoes, rugby shoes, baseball shoes as well as other kinds of shoes. As shown in FIGS. 1-3, article of footwear 100, also referred to simply as article 100, is intended to be used with a right foot; however, it should be understood that the following discussion may equally apply to a mirror image of article of footwear 100 that is intended for use with a left foot.

Article of footwear 100 preferably includes upper 102. Generally, upper 102 may be any type of upper. In particular, upper 102 could have any design, shape, size and/or color. For example, in embodiments where upper 102 is a basketball shoe, upper 102 could be a high top upper that is shaped to provide high support for an ankle. In embodiments where upper 102 is a running shoe, upper 102 could be a low top upper.

Preferably, upper 102 is configured to receive a foot of a wearer. In some embodiments, upper 102 includes entry hole 103 configured to receive a foot of a wearer. Typically, entry hole 103 allows a foot to be inserted into an interior of upper 102.

Referring to FIG. 1, upper 102 may also include medial portion 106. Also, upper 102 may include lateral portion 107 disposed opposite medial portion 106, as illustrated in FIG. 2. Preferably, medial portion 106 may be associated with an inside of a foot. Similarly, lateral portion 107 may be associated with an outside of a foot.

Upper 102 may include toe portion 113 that is associated with the toes of a foot. Also, upper 102 may include heel portion 114 that is associated with a heel of a foot, as illustrated in FIG. 3. Upper 102 may also include middle portion 115 that is disposed between toe portion 113 and heel portion 114. In some cases, middle portion 115 is associated with a midfoot, including an arch of the foot and a top of the foot.

For purposes of clarity, only some portions of upper 102 are discussed in this embodiment. It should be understood that upper 102 may include other provisions that are known in the art for an upper of an article of footwear. For example, upper 102 may include a fastening system to secure upper 102 to a foot inserted within article 100. Also, in some cases, upper 102 may be configured with provisions to increase the stability of a foot inserted within article 100.

In some embodiments, upper 102 may be associated with sole system 105. Sole system 105 may comprise multiple components. In some cases, sole system 105 may include an outsole. In other cases, sole system 105 may include a midsole. In still other cases, sole system 105 may include an insole. In one embodiment, sole system 105 may include an outsole, a midsole and an insole.

In an embodiment, sole system 105 includes lower surface 125. Lower surface 125 is configured to contact a ground surface. For clarity, only some portions of sole system 105 are discussed in this embodiment. It should be understood that sole system 105 may include other provisions. For example, in some embodiments, lower surface 125 can be provided with one or more tread elements. In other embodiments, lower surface 125 can include one or more cleats that are configured to penetrate through a ground surface such as grass.

In some embodiments, upper 102 may comprise first portion 131 and second portion 132. In some cases, first portion 131 may be associated with a top portion of upper 102. Similarly, second portion 132 may be associated with a peripheral edge of upper 102. Second portion 132 can be disposed adjacent to sole system 105. In particular, second portion 132 is disposed between first portion 131 and sole system 105. For illustrative purposes, first portion 131 and second portion 132 are separated by boundary 133 in FIGS. 1-3.

Generally, each component of article of footwear 100 may be constructed of any material. Sole system 105 may be constructed from any suitable material, including but not limited to elastomers, siloxanes, natural rubber, other synthetic rubbers, aluminum, steel, natural leather, synthetic leather, or plastics. Also, upper 102 may be made from any suitable material, including but not limited to, nylon, natural leather, synthetic leather, natural rubber, or synthetic rubber.

In order to effectively train an athlete, a trainer may be required to accurately study the positioning of a foot of the athlete during various athletic drills. In embodiments where the motions of the foot of an athlete may be accurately studied, an article of footwear may include provisions to help a trainer accurately determine the location of one or more portions of a foot of the athlete. In some embodiments, one or more markings may be provided on an article of footwear in order to enable a trainer to properly locate one or more portions of the foot. In some cases, a marking system may be provided on an upper of an article of footwear to enable a trainer to accurately locate one or more portions of a foot.

Referring to FIGS. 1-4, upper 102 of article 100 includes marking system 410. Generally, marking system 410 may be disposed on any portion of upper 102. In some cases, marking system 410 may extend through first portion 131 and second portion 132 of upper 102. In other cases, marking system 410 can be disposed in second portion 132 of upper 102. In this embodiment, marking system 410 extends through first portion 131 of upper 102.

Generally, marking system 410 includes a set of markings to help locate one or more portions of a foot during training of an athlete. In some embodiments, a set of markings can include less than four markings. In other embodiments, a set of markings can include more than four markings. In an embodiment, a set of markings can include four markings. In particular, marking system 410 includes first marking 411, second marking 412, third marking 413 and fourth marking 414.

In different embodiments, the location of marking system 410 may vary within first portion 131. In some embodiments, marking system 410 may be disposed on toe portion 113 of upper 102. In other embodiments, marking system 410 may be disposed on middle portion 115 of upper 102. In still other embodiments, marking system 410 may be disposed on heel portion 114 of upper 102. In this embodiment, marking system 410 is disposed in toe portion 113, middle portion 115 and heel portion 114 to facilitate locating a predetermined portion of a foot. Specifically, first marking 411 is disposed on toe portion 113. In addition, second marking 412 is disposed on lateral portion 107 of middle portion 115. Similarly, fourth marking 414 is disposed on medial portion 106 of middle portion 115. Finally, third marking 413 is disposed on heel portion 114 of upper 102.

Referring to FIG. 3, third marking 413 may be disposed in various locations on first portion 131 of heel portion 114 in order to facilitate locating a predetermined portion of a foot. In some embodiments, first portion 131 of heel portion 114 can include first end portion 201 disposed adjacent to entry hole 103, as illustrated in FIG. 3. Similarly, first portion 131 of heel portion 114 can include second end portion 202 disposed adjacent to second portion 132. Also, first portion 131 of heel portion 114 can include intermediate portion 203 disposed between first end portion 201 and second end portion 202. In some cases, third marking 413 may be disposed on first end portion 201 of first portion 131. In other cases, third marking 413 can be disposed on second end portion 202 of first portion 131. In still other cases, third marking 413 may be disposed on intermediate portion 203 of first portion 131. It is also possible that third marking 413 can extend through any or all portions of first portion 131 of heel portion 114. In this embodiment, third marking 413 is disposed on first end portion 201 of heel portion 114.

Figure 4:
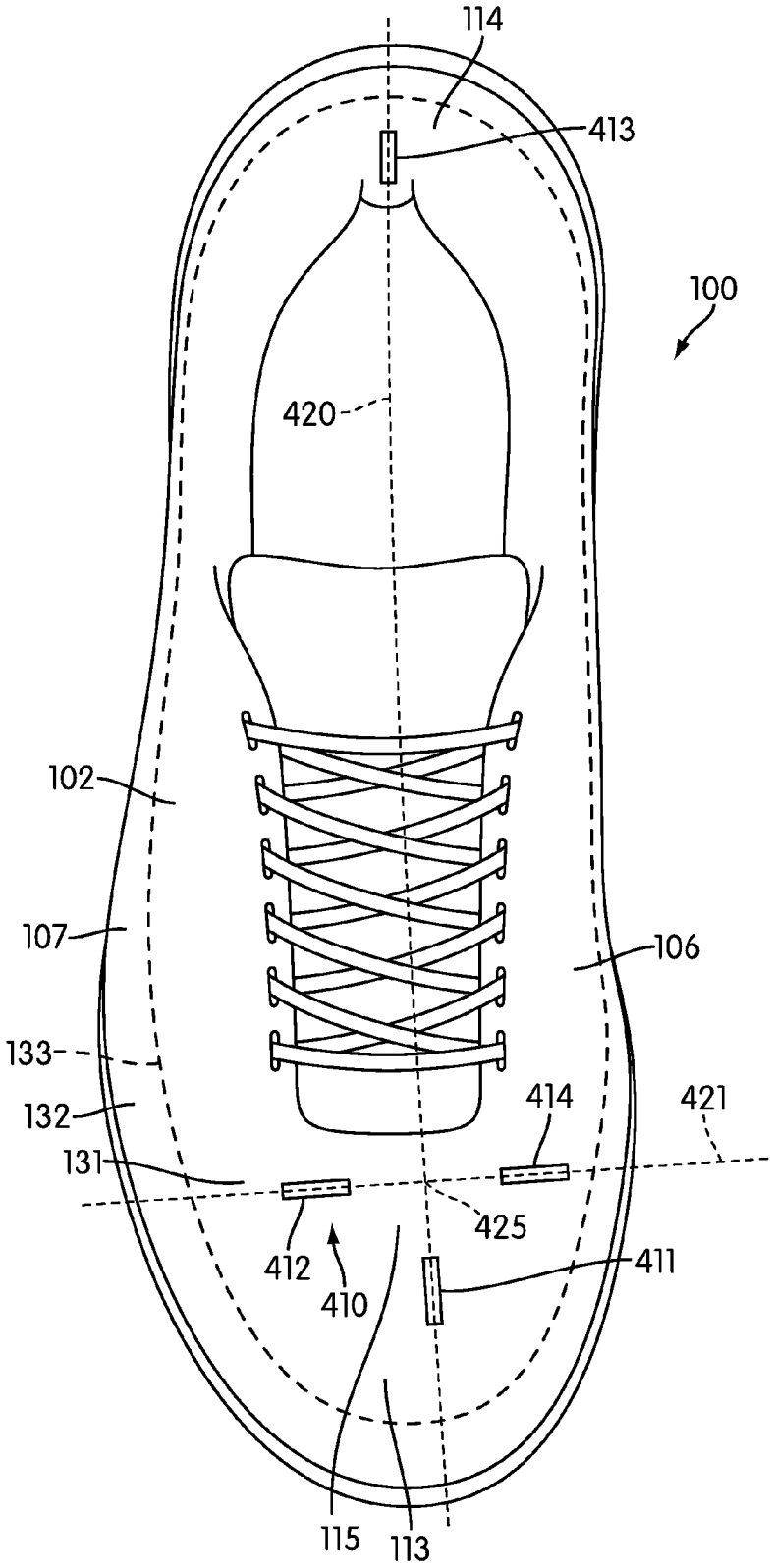
FIG. 4 is a top view of an embodiment of an article of footwear.

As previously discussed in the Marking System Case, which has already been incorporated herein by reference, a marking system may be used to implicitly define a longitudinal axis and a lateral axis to assist in locating a predetermined portion of a foot. Referring to FIG. 4, first marking 411 extends from toe portion 113 of upper 102 towards heel portion 114. Likewise, third marking 413 extends from heel portion 114 towards toe portion 113. In an embodiment, first marking 411 and third marking 413 may be substantially co-linear. In particular, first marking 411 and third marking 413 may be aligned with longitudinal axis 420. The term "longitudinal axis" as used throughout this detailed description and in the claims refers to an axis that extends in a longitudinal direction, which is a direction extending the length of article 100, including sole system 105 and upper 102.

In a similar manner, second marking 412 may extend from lateral portion 107 towards medial portion 106. Likewise, fourth marking 414 may extend from medial portion 106 towards lateral portion 107. In an embodiment, second marking 412 and fourth marking 414 may be substantially co-linear. In particular, second marking 412 and fourth marking 414 may be aligned with lateral axis 421, as illustrated in FIG. 4. The term "lateral axis" as used throughout this detailed description and in the claims refers to an axis that extends in a lateral direction, which is a direction running a width of article 100, including sole system 105 and upper 102. With this arrangement, marking system 410 may be used to implicitly define longitudinal axis 420 and lateral axis 421.

By defining longitudinal axis 420 and lateral axis 421, marking system 410 can indicate an intersection of longitudinal axis 420 and lateral axis 421 that corresponds to a predetermined portion of a foot. In some cases, marking system 410 may include a marking to indicate the intersection of longitudinal axis 420 and lateral axis 421. In other cases, marking system 410 may implicitly indicate the intersection of longitudinal axis 420 and lateral axis 421.

Generally, longitudinal axis 420 and lateral axis 421 may be configured to intersect in any portion of upper 102 in order to indicate a portion or feature of a foot. In some embodiments, longitudinal axis 420 and lateral axis 421 are configured to intersect in a forefoot portion of upper 102. In some cases, longitudinal axis 420 and lateral axis 421 can intersect in a portion of upper 102 that corresponds to a ball of a foot. In other cases, longitudinal axis 420 and lateral axis 421 can intersect in an arch portion of upper 102 to help a trainer accurately locate the arch of a foot during a training session. Likewise, in other embodiments, the intersection of longitudinal axis 420 and lateral axis 421 could correspond with one or more bones in a foot, including, but not limited to, phalanges, metatarsals, cuniforms and the calcaneus, as well as other bones. In still other embodiments, the intersection of longitudinal axis 420 and lateral axis 421 could be associated with a particular muscle in a foot.

In this embodiment, longitudinal axis 420 and lateral axis 421 intersect at ball portion 425. Preferably, ball portion 425 is a location disposed on upper 102 that corresponds to a ball of a foot inserted within article 100 during the use of article 100. In other words, ball portion 425 is disposed just above the ball of the foot of an athlete. With this configuration for marking system 410, a trainer may accurately determine the location of ball portion 425 by knowing the locations of at least two markings of marking system 410 that implicitly define longitudinal axis 420 and lateral axis 421. This allows the trainer to determine the location of ball portion 425 by finding the intersection point of longitudinal axis 420 and lateral axis 421 that is associated with marking system 410.

As previously discussed in the Marking System Case, in different embodiments, the shape of each marking of a marking system can vary. In some embodiments, each marking can be a straight line with a generally constant thickness. In other embodiments, each marking can be a straight line with varying thickness. In still other embodiments, each marking can have another shape, including, but not limited to, triangular shapes, rectangular shapes, elliptical shapes, regular shapes, irregular shapes as well as other types of shapes.

A marking system can be applied to an upper in any manner. For example, in one embodiment, a marking system may be painted onto an upper using a durable paint. In another example, a marking system can comprise portions of a distinct material that is applied to the upper. Examples of materials that could be used for a marking system include, but are not limited to, plastic, rubber, leather, natural fibers, synthetic fibers, metal as well as other types of materials. In some cases, a marking system may be applied to an upper using an adhesive of some kind. In other cases, a marking system may be applied to an upper using some type of stitching.

Figure 5:
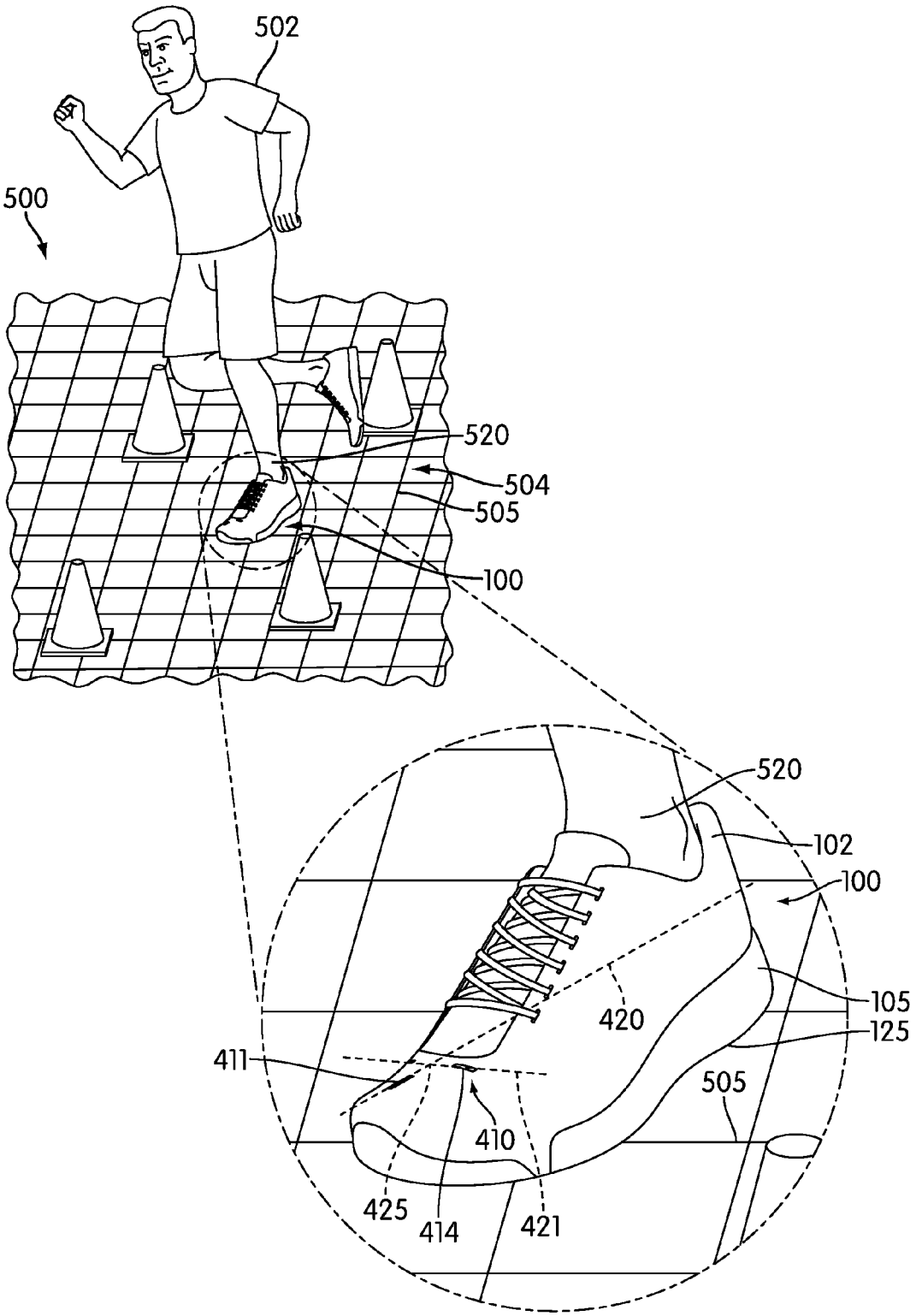
FIG. 5 is a schematic view of an exemplary embodiment of a training system.

In some cases, a trainer of an athlete may monitor the movement of a foot of an athlete while using a training system. FIG. 5 illustrates an exemplary embodiment of training system 500 for an athlete. In this case, training system 500 is associated with practice field 504. The term "practice field", as used throughout this detailed description and in the claims refers to any type of field, court, or generally open space that may be used for training activities. Examples of practice fields include, but are not limited to football fields, soccer pitches or fields, lacrosse fields, basketball courts, as well as other types of fields and/or courts. Additionally, any open space that may be used for training activities such as those described throughout this detailed description may also be considered a practice field.

Preferably, training system 500 includes athlete 502. Referring to the Marking System Case, the term "athlete" is intended to include both professional athletes and amateur athletes. Generally, athlete 502 may be any person wishing to take part in an athletic training activity. Therefore, the term "athlete", as used throughout this detailed description and in the claims, refers to any user of training system 500.

Preferably, an article of footwear used with training system 500 includes provisions for training an athlete with respect to various athletic skills that are important for a strong performance in many sports. Examples of these athletic skills include, but are not limited to stride length, forefoot planting technique, linear speed, lateral speed, left turning speed, right turning speed, starting acceleration, mid-stride acceleration, deceleration as well as other capabilities. For example, a running back in football must have good lateral speed in order to avoid tackles. Therefore, it may be important to have a training system with special emphasis placed on one or more of these athletic skills.

In some cases, practice field 504 may include provisions to assist in accurately locating athlete 502 on practice field 504. For example, in this embodiment, practice field 504 includes grid 505. Generally, grid 505 can be any type of grid. Furthermore, grid 505 can include any size spacing. In this embodiment, the size of grid 505 can be selected to allow for accurate measurements of the locations of a portion of a foot during a training session.

As previously discussed in the Marking System Case, a training system can include provisions such as a monitoring device to capture the movements of a foot of an athlete during a training session. Monitoring devices include, but are not limited to camera, video cameras as well as other devices configured to capture the movement of an athlete. Furthermore, a monitoring device may be associated with one or more provisions for receiving information about the performance of an athlete during a training session. In some cases, a monitoring device may be communication with a computer. The term "computer" refers to any device including a central processing unit, some kind of memory, a user interface and mechanisms for input/output. In addition, a monitoring device may be in communication with a video display system. The term "video display system" as used throughout this detailed description and in the claims refers to any system that includes provisions for displaying one or more video images received from a monitoring device. For purposes of clarity, a monitoring device and other associated devices such as a computer and video display system are not shown with training system 500. However, it should be understood that a trainer may utilize these devices with a training system as described in embodiments in the Marking System Case.

Referring to FIG. 5, as athlete 502 moves on practice field 504, a trainer may determine the motion of foot 520 during a portion of the training session. For example, the trainer may wish to determine the exact location of the ball of foot 520 during a particular athletic maneuver in order to determine if athlete 502 is performing the maneuver correctly. Preferably, training system 500 includes provisions for assisting a trainer in accurately determining the location of one or more portions of foot 520, such as the ball of foot 520.

In this embodiment, athlete 502 is wearing article 100 as seen in the enlarged view in FIG. 5. As previously discussed, article 100 is configured with marking system 410. Furthermore, marking system 410 includes first marking 411, second marking 412, third marking 413, and fourth marking 414. However, only first marking 411 and fourth marking 414 may be visible on upper 102. In other words, due to the positioning of foot 520, a trainer can only see first marking 411 and fourth marking 414.

In order to accurately determine the location of ball portion 425, a trainer may utilize marking system 410. Preferably, the trainer may observe the location of a plurality of markings of marking system 410 to determine the location of ball portion 425. In this case, the trainer may observe the location of first marking 411 by inspecting article 100. Also, the trainer may determine the location of fourth marking 414 in a similar manner. At this point, the trainer may associate longitudinal axis 420 with first marking 411 and lateral axis 421 with fourth marking 414. In some cases, this can be accomplished with a graphical program of some kind that may be associated with a computer. In other cases, a trainer can mentally estimate the locations of longitudinal axis 420 and lateral axis 421. Preferably, the trainer may then proceed to determine where longitudinal axis 420 and lateral axis 421 may intersect. The point of intersection then allows the trainer to identify the location of ball portion 425. Furthermore, using grid 505, the trainer can accurately determine the location of a ball of foot 520 with respect to practice field 404. In some cases, a trainer can repeat these steps to determine the location of ball portion 425 throughout a particular time interval of the training session as previously discussed in the Marking System Case.

Although the current embodiment discusses a single foot with a single article of footwear, it should be understood that training system 500 can be used to monitor and accurately study both feet of athlete 502 including an associated pair of footwear. Furthermore, although the current embodiment is used for determining the accurate location of a ball of a foot, in other embodiments, a marking system for an article of footwear can be used to accurately locate other portions of a foot, such as a toe portion, an arch portion, a heel portion, as well as other portions. In addition, in some embodiments, multiple marking systems can be used on an article of footwear for simultaneous location of multiple portions of a foot.

Figure 6:
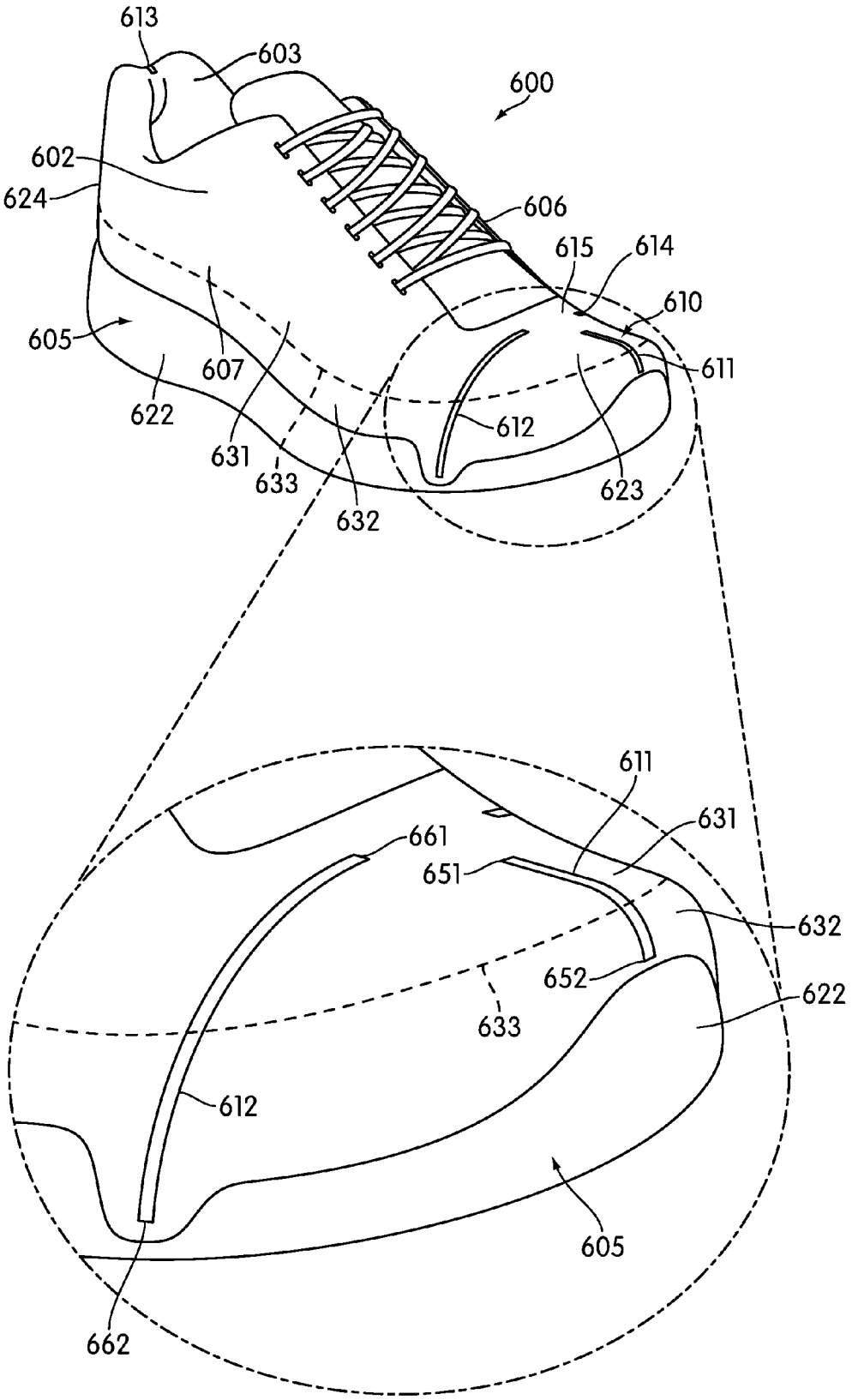
FIG. 6 is an isometric view of an alternative embodiment of a lateral portion of an article of footwear.
Figure 7:
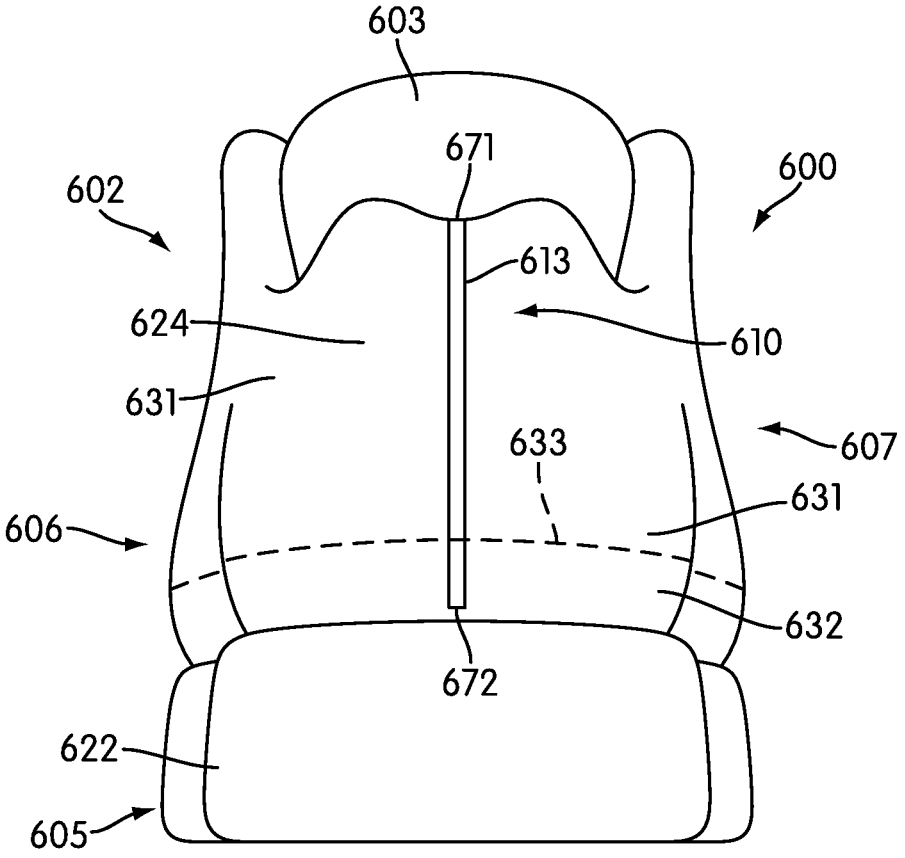
FIG. 7 is an isometric view of an alternative embodiment of a heel portion of an article of footwear.

FIGS. 6 and 7 are isometric views of an alternative embodiment of article of footwear 600. FIG. 6 illustrates an isometric view with an enlarged view of an alternative embodiment of a lateral portion of article of footwear 600. FIG. 7 is an isometric view of an alternative embodiment of a heel portion of article of footwear 600.

Referring to FIGS. 6 and 7, article 600 includes upper 602. Generally, upper 602 may be any type of upper. In particular, upper 602 could have any design, shape, size and/or color. In addition, upper 602 includes medial portion 606 and lateral portion 607, disposed opposite of medial portion 606. Also, upper 602 is configured with middle portion 615 that is disposed between toe portion 623 and heel portion 624 of upper 602.

In this embodiment, upper 602 is associated with sole system 605. Sole system 605 may comprise multiple components. In particular, sole system 605 can include an outsole, midsole and/or an insole. Furthermore, sole system 605 may be associated with outer peripheral portion 622. Preferably, outer peripheral portion 622 is a side edge of sole system 605. In other words, outer peripheral portion 622 may be visible in a side view of article 600. In some cases, outer peripheral portion 622 may be configured with a straight edge as outer peripheral portion 622 joins upper 602. In this embodiment, outer peripheral portion 622 is configured with a contoured edge as outer peripheral portion 622 joins upper 602.

Similar to the previous embodiment of upper 102 illustrated in FIGS. 1-4, upper 602 includes first portion 631 and second portion 632. As previously described, second portion 632 is disposed between first portion 631 and sole system 605. For illustrative purposes, first portion 631 is separated from second portion 632 by boundary 633 in FIGS. 6 and 7.

In embodiments where a trainer may have difficulty viewing a first portion of an upper, a marking system may be disposed in a second portion of an upper to facilitate accurately locating one or more portions of a foot. In some cases, a marking system may be disposed in a second portion of an upper without extending into a first portion of an upper. In other cases, a marking system may extend through both a first portion and a second portion of an upper.

In this alternative embodiment, upper 602 includes marking system 610. Similar to the previous embodiment of marking system 410 illustrated in FIG. 4, marking system 610 includes first marking 611, second marking 612, third marking 613 and fourth marking 614. However, in this embodiment, marking system 610 is disposed in both first portion 631 and second portion 632 of upper 602. In particular, first marking 611 extends through both first portion 631 and second portion 632 on toe portion 623. Similarly, second marking 612 extends through first portion 631 and second portion 632 on lateral portion 607 of middle portion 615.

As seen in the enlarged view, first marking 611 includes first end portion 651 and second end portion 652 on toe portion 623. First end portion 651 is disposed in first portion 631 of upper 602. Likewise, second end portion 652 is disposed in second portion 632 of upper 602. Furthermore, second end portion 652 is disposed adjacent to outer peripheral portion 622 of sole system 605. However, second end portion 652 does not contact sole system 605. With this arrangement, first marking 611 extends through first portion 631 and second portion 632.

In a similar manner, second marking 612 is configured with first end portion 661 and second end portion 662. First end portion 661 is disposed in first portion 631 of upper 602. Similarly, second end portion 662 is disposed in second portion 632 of upper 602. In particular, second end portion 662 is disposed adjacent to outer peripheral portion 622 without contacting outer peripheral portion 622. In other words, second end portion 662 may extend into second portion 632 and be spaced apart from sole system 605. Preferably, fourth marking 614 is disposed on medial portion 606 in a substantially similar manner.

Referring to FIG. 7, third marking 613 of marking system 610 is disposed on heel portion 624. Third marking 613 extends between first end portion 671 and second end portion 672. First end portion 671 is disposed in first portion 631. Specifically, first end portion 671 is disposed adjacent to entry hole 603 of upper 602. Similarly, second end portion 672 is disposed in second portion 632. In particular, second end portion 672 is disposed adjacent to sole system 605. However, like the other markings of marking system 610, third marking 613 does not contact sole system 605 as third marking 613 extends through first portion 631 and second portion 632. With this arrangement of marking system 610, a trainer can observe the markings of marking system 610 when either first portion 631 or second portion 632 of upper 602 is obscured.

In embodiments where an upper extends to an outsole of a sole system, a marking system on the upper may be disposed adjacent to the outsole. In some cases, an upper may cover a midsole of a sole system as the upper extends to an outsole. In other cases, an upper may extend to an outsole of a sole system that is configured without a midsole. Preferably, an upper that extends to an outsole can be provided with a marking system that enables a trainer to accurately locate one or more portions of a foot.

Figure 8:
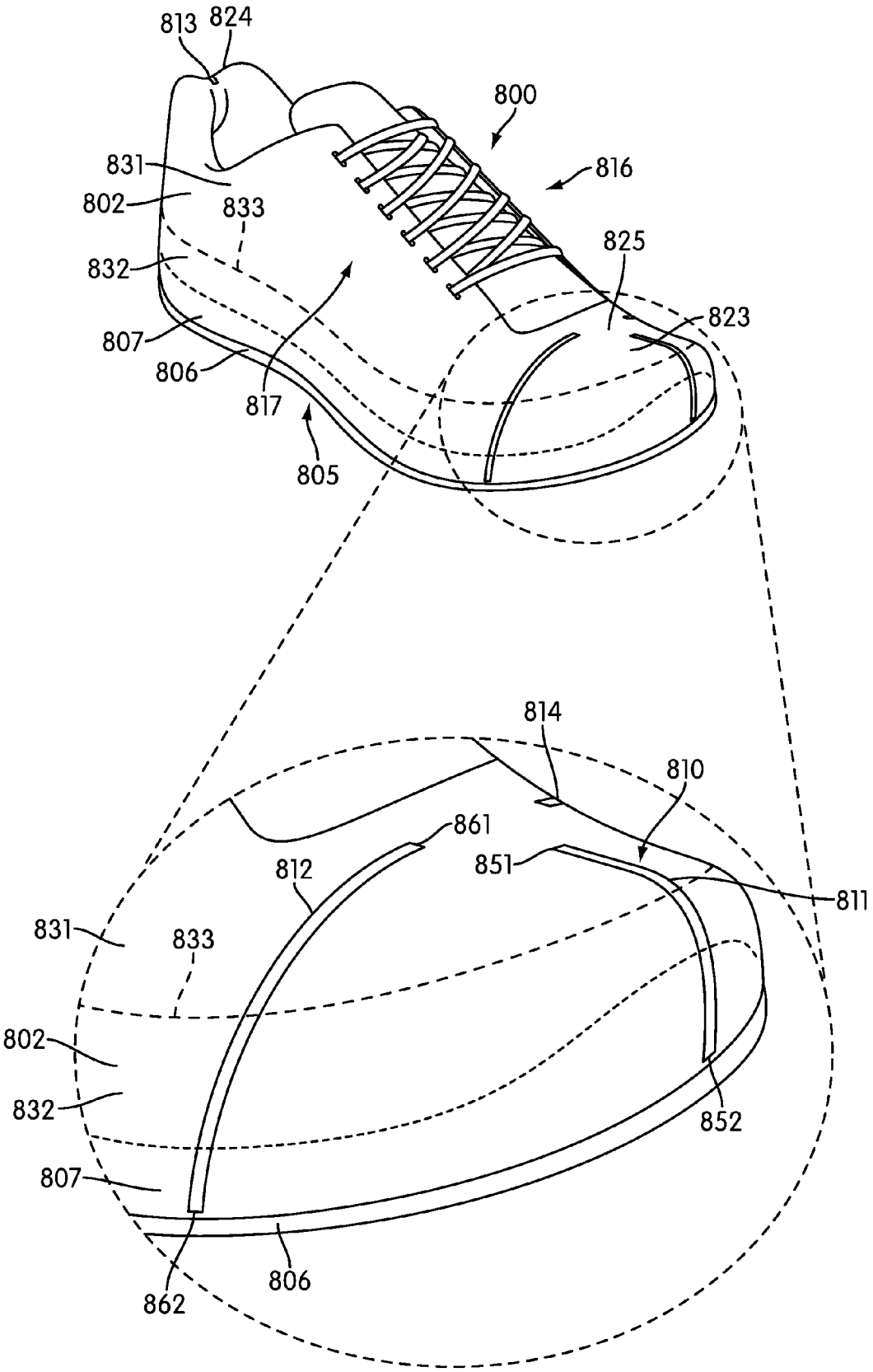
FIG. 8 is an isometric view of an alternative embodiment of a lateral portion of an article of footwear.

FIG. 8 illustrates an isometric view of an alternative embodiment of a lateral portion of article of footwear 800. In this embodiment, article of footwear 800 includes upper 802 and sole system 805. Upper 802 includes toe portion 823 and heel portion 824. Also, upper 802 includes middle portion 825 disposed between toe portion 823 and heel portion 824. Furthermore, in a similar manner to previous embodiments, upper 802 includes first portion 831 and second portion 832 disposed between first portion 831 and sole system 805. For illustrative purposes, boundary 833 is shown between first portion 831 and second portion 832.

In this embodiment, sole system 805 includes outsole 806 and midsole 807. Sole system 805 may also include an insole not visible in this Figure. Preferably, outsole 806 is configured to contact a ground surface. Midsole 807 is disposed above outsole 806. However, in this alternative embodiment, upper 802 extends to outsole 806 and covers midsole 807. Specifically, second portion 832 of upper 802 covers midsole 807. For illustrative purposes, midsole 807 is illustrated with a dashed line on upper 802.

In this alternative embodiment, upper 802 is configured with marking system 810 to facilitate locating a predetermined portion of a foot inserted within upper 802. Marking system 810 is substantially similar to marking system 410 illustrated in FIGS. 1-4. In particular, marking system 810 includes first marking 811, second marking 812, third marking 813 and fourth marking 814. In some cases, marking system 810 may not extend through both first portion 831 and second portion 832 of upper 802. In this embodiment, markings of marking system 810 extend through first portion 831 and second portion 832 of upper 802. With this configuration, marking system 810 may be disposed on a portion of upper 802 that covers midsole 807.

As seen in the enlarged view, first marking 811 includes first end portion 851 and second end portion 852 on toe portion 823. First end portion 851 is disposed in first portion 831 of upper 802. Likewise, second end portion 852 is disposed in second portion 832 of upper 802. In particular, second end portion 852 is disposed adjacent to outsole 806 of sole system 805. This arrangement allows first marking 811 to extend through first portion 831 and into second portion 832 as second portion 832 covers midsole 807. With this arrangement, first marking 811 is disposed adjacent to outsole 806.

In a similar manner, second marking 812 is configured with first end portion 861 and second end portion 862. First end portion 861 is disposed in first portion 831 of upper 802. Similarly, second end portion 862 is disposed in second portion 832 of upper 802. In particular, second end portion 862 is disposed adjacent to outsole 806. In other words, second end portion 862 may extend into second portion 832 as second portion 832 covers midsole 807. Using this arrangement, second marking 812 may extend through first portion 831 and second portion 832 of upper 802.

Preferably, fourth marking 814 is disposed on medial portion 816 of upper 802 in a substantially similar manner as second marking 812 on lateral portion 817. Additionally, third marking 813 may be disposed on heel portion 824 of upper 802 in a manner substantially similar to the previous embodiment of marking system 610 illustrated in FIG. 7. However, in this embodiment, third marking 813 may extend into second portion 832 as second portion 832 covers midsole 807. With this arrangement, a portion of third marking 813 may be disposed adjacent to outsole 806. This configuration of marking system 810 preferably allows a trainer to accurately locate one or more predetermined portions of a foot.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear having a forefoot portion configured to correspond with a forefoot region of a wearer's foot, a middle portion configured to correspond with a midfoot region of the wearer's foot wearer, and a heel portion configured to correspond with a heel region of the wearer's foot earer, the article of footwear comprising:

a sole system having an outer peripheral portion forming a side edge of the sole system that is visible in a side view of the article of footwear, the outer peripheral portion including a contoured edge defining a recess in the sole system extending in a downward direction from a top edge of the outer peripheral portion of the sole system, the recess being disposed in the forefoot portion of the article of footwear and being substantially smaller than the forefoot portion;

an upper attached to the sole system, the upper including a first section and a second section, the first section of the upper being defined by the contoured edge of the outer peripheral portion and being located below the top edge of the outer peripheral portion, wherein the first section of the upper is exposed in the recess in the sole system, and wherein the second section of the upper is located above the top edge of the outer peripheral portion of the sole system; and a plurality of markings on the upper, each marking of the plurality of markings having a different appearance than adjacent portions of the upper;

the plurality of markings including a marking system including a set of markings arranged in alignment with one or more portions of the article of footwear configured to correspond with at least one predetermined portion of the wearer's foot;

wherein an end portion of a first marking of the plurality of markings extends into the first section of the upper in the recess defined by the outer peripheral portion of the sole system;

wherein all markings adjacent to the first marking and perpendicular to the first marking are disposed entirely in the second portion of the upper;

wherein the first marking extends in a lateral direction in alignment with a first axis that is configured to correspond with a ball of the wearer's foot: and wherein the upper includes an unmarked portion between the sole system and the end portion of the marking extending into the recess.

2. The article of footwear of claim 1, wherein the plurality of markings are aligned with axes, including the first axis and a second axis, that intersect at a portion of the upper that is configured to correspond with the predetermined portion of the foot;

wherein the plurality of markings includes at least one heel marking located on the upper in the heel portion of the article of footwear;

wherein the heel marking has a first end portion located adjacent an entry hole of the upper, the heel marking extending from the first end portion toward the sole system to a second end portion of the heel marking; and wherein the upper includes an unmarked portion between the sole system and the second end portion of the heel marking.

3. The article of footwear according to claim 2, wherein the marking system includes a marking disposed in a toe portion of the upper.

4. The article of footwear according to claim 2, wherein the marking system includes a marking disposed in a lateral portion of the upper.

5. The article of footwear according to claim 2, wherein the marking system includes a marking disposed in a medial portion of the upper.

6. The article of footwear according to claim 2, wherein at least one of the plurality of markings extends to an outsole of the sole system.

7. The article of footwear of claim 1, wherein the marking system includes a first marking, a second marking, a third marking, and a fourth marking;

wherein the second marking and the fourth marking define the first axis in a lateral direction along a width of the sole system;

wherein the first marking and the third marking define a second axis extending in a longitudinal direction along a length of the sole system;

wherein the intersection of the first axis and the second axis is configured to correspond to a predetermined bone of the foot; and wherein the intersection is located laterally off center along the width of the sole system.

8. A monitoring system including the article of footwear of claim 7 and a monitoring device configured to capture movements of the wearer's foot by locating the plurality of markings.

9. The system according to claim 7, wherein the first axis and the second axis intersect in the forefoot portion of the upper.

10. The system according to claim 7, wherein the marking set has a cross-hair configuration.

11. The system according to claim 7, wherein a portion of the marking system is visible when the article of footwear is planted on the ground.

12. The article of footwear according to claim 1, wherein the end portion of the marking extending into the recess is disposed in a medial portion of the upper.

13. The article of footwear according to claim 1, wherein the end portion of the marking extending into the recess is disposed in a lateral portion of the upper.

14. The article of footwear according to claim 1, wherein the plurality of markings are aligned with axes, including the first axis and a second axis, that intersect at a portion of the upper that is configured to correspond with the predetermined portion of the foot.

15. The article of footwear according to claim 14, wherein the predetermined portion of the foot is a ball of the foot.

16. A monitoring system including the article of footwear of claim 1 and a monitoring device configured to capture movements of the wearer's foot by locating the plurality of markings.

17. The article of footwear according to claim 1, wherein a second marking adjacent to the first marking is disposed entirely in the second portion of the upper.

* * * * *